US007281301B2

(12) United States Patent
Huang et al.

(10) Patent No.: US 7,281,301 B2
(45) Date of Patent: Oct. 16, 2007

(54) FIXING STRUCTURE FOR A DOOR HANDLE

(75) Inventors: Lan-Shi Huang, Kaohsiung (TW); Kuang-Chun Chiang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 183 days.

(21) Appl. No.: 11/041,574

(22) Filed: Jan. 24, 2005

(65) Prior Publication Data

US 2006/0162127 A1 Jul. 27, 2006

(51) Int. Cl.
*E05B 1/00* (2006.01)

(52) U.S. Cl. ..... 16/412

(58) Field of Classification Search ..... 16/412, 16/413, 414, 444, 436; 292/336.3, 347, 348, 292/DIG. 53, DIG. 54, DIG. 60, DIG. 64; 248/220.22, 222.14, 225.11, 241, 244, 243; 403/387

See application file for complete search history.

(56) References Cited

U.S. PATENT DOCUMENTS 2,325,292 A * 7/1943 Westrope ..... 297/411.21
2,345,650 A * 4/1944 Attwood ..... 403/21
2,604,721 A * 7/1952 Casciano ..... 43/57.2
2,767,951 A * 10/1956 Cousino ..... 248/245
3,107,113 A * 10/1963 Sconzo ..... 292/228
3,197,803 A * 8/1965 Williamson ..... 16/416
3,339,953 A * 9/1967 Bohn ..... 403/387
4,278,309 A * 7/1981 Dreiling ..... 384/22
4,905,444 A * 3/1990 Semaan et al. ..... 52/710
5,084,940 A * 2/1992 Loffler et al. ..... 16/412
5,092,144 A * 3/1992 Fleming et al. ..... 70/95
5,762,387 A * 6/1998 Edgerly et al. ..... 292/357
2005/0156439 A1* 7/2005 Furlong ..... 292/336.3

FOREIGN PATENT DOCUMENTS

DE 3407700 A * 9/1985
DE 10010709 C1 * 8/2001
EP 1076140 A1 * 2/2001
FR 2739888 A1 * 4/1997
GB 2177153 A * 1/1987
JP 10339059 A * 12/1998

* cited by examiner

*Primary Examiner*—Chuck Y. Mah
(74) *Attorney, Agent, or Firm*—Alan Kamrath; Kamrath & Associates P.A.

(57) ABSTRACT

A fixing structure for a door handle includes a grip portion, a first fixing portion connected to a first end of the grip portion and fixed to a side of a door, and a second fixing portion connected to a second end of the grip portion and fixed to the side of a door. A guiding plate is fixedly mounted to the second fixing portion. At least one fixing tube is slidably mounted to the guiding plate, thereby adjusting a mounting position of the at least one fixing tube.

16 Claims, 7 Drawing Sheets

FIXING STRUCTURE FOR A DOOR HANDLE

BACKGROUND OF THE INVENTION

1. Field of the Invention The present invention relates to a fixing structure for a handle. In particular, the present invention relates to a fixing structure for a door handle.

2. Description of Related Art

FIG. 1 of the drawings illustrates a conventional door handle comprising a grip portion 1, a first fixing portion 2, and a second fixing portion 3. The grip portion 1 has two ends respectively connected to the first fixing portion 2 and the second fixing portion 3. The first and second fixing portions 2 and 3 are used to fix the handle to a door 4. The first fixing portion 2 includes a plurality of screw holes 21, and the second fixing portion 3 includes a fixing tube 31 with an inner threading. The door 4 includes a plurality of first mounting holes 41 associated with the screw holes 21 of the first fixing portion 2, and a plurality of first screws 22 are extended through the first fixing holes 41 into the screw holes 21. The door 4 further includes a second mounting hole 42, and a second screw 32 is extended through the second mounting hole 42 to engage with the inner threading of the fixing tube 31. The handle is, thus, screwed to the door 4.

However, since the screw holes 21 are integrally formed on the first fixing portion 2 and since the fixing tube 31 is integrally formed on the second fixing portion 3, the distance from the fixing tube 31 to each of the screw holes 21 is fixed. Hence, drilling of the first mounting holes 41 and the second mounting hole 42 must be carefully performed to make the first mounting holes 41 and the second mounting hole 42 exactly align with the screw holes 21 and the fixing tube 31 respectively. However, precise drilling of the first mounting holes 41 and the second mounting hole 42 could not be achieved every time, leading to troublesome mounting of the handle to the door 4.

OBJECTS OF THE INVENTION

An object of the present invention is to provide a fixing structure for a door handle that allows easy, flexible mounting of the door handle to a door.

SUMMARY OF THE INVENTION

A fixing structure for a door handle in accordance with the present invention comprises a grip portion, a first fixing portion connected to a first end of the grip portion and fixed to a side of a door, and a second fixing portion connected to a second end of the grip portion and fixed to the side of a door. A guiding plate is fixedly mounted to the second fixing portion. At least one fixing tube is slidably mounted to the guiding plate, thereby adjusting a mounting position of the at least one fixing tube.

The at least one fixing tube includes a movable plate fixed to an end thereof.

In an embodiment of the invention, the second fixing portion further includes a groove for slidingly receiving the movable plate. The guiding plate further includes a slot through which the at least one fixing tube extends. An elastic element is mounted between a bottom wall delimiting the groove and the movable plate to bias the movable plate to press against the guiding plate, thereby retaining the at least one fixing tube in place. The guiding plate further comprises two abutting flanges on two lateral edges delimiting the slot, and the movable plate abuts against the abutting flanges.

In another embodiment of the invention, the movable plate is substantially C-shaped and slidably embraces two lateral sides of the guiding plate. The second fixing portion further includes at least one protrusion to which the guiding plate is fixedly mounted.

Preferably, a latch mechanism and a linking mechanism are mounted to the first fixing portion to provide a locking/unlocking structure.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
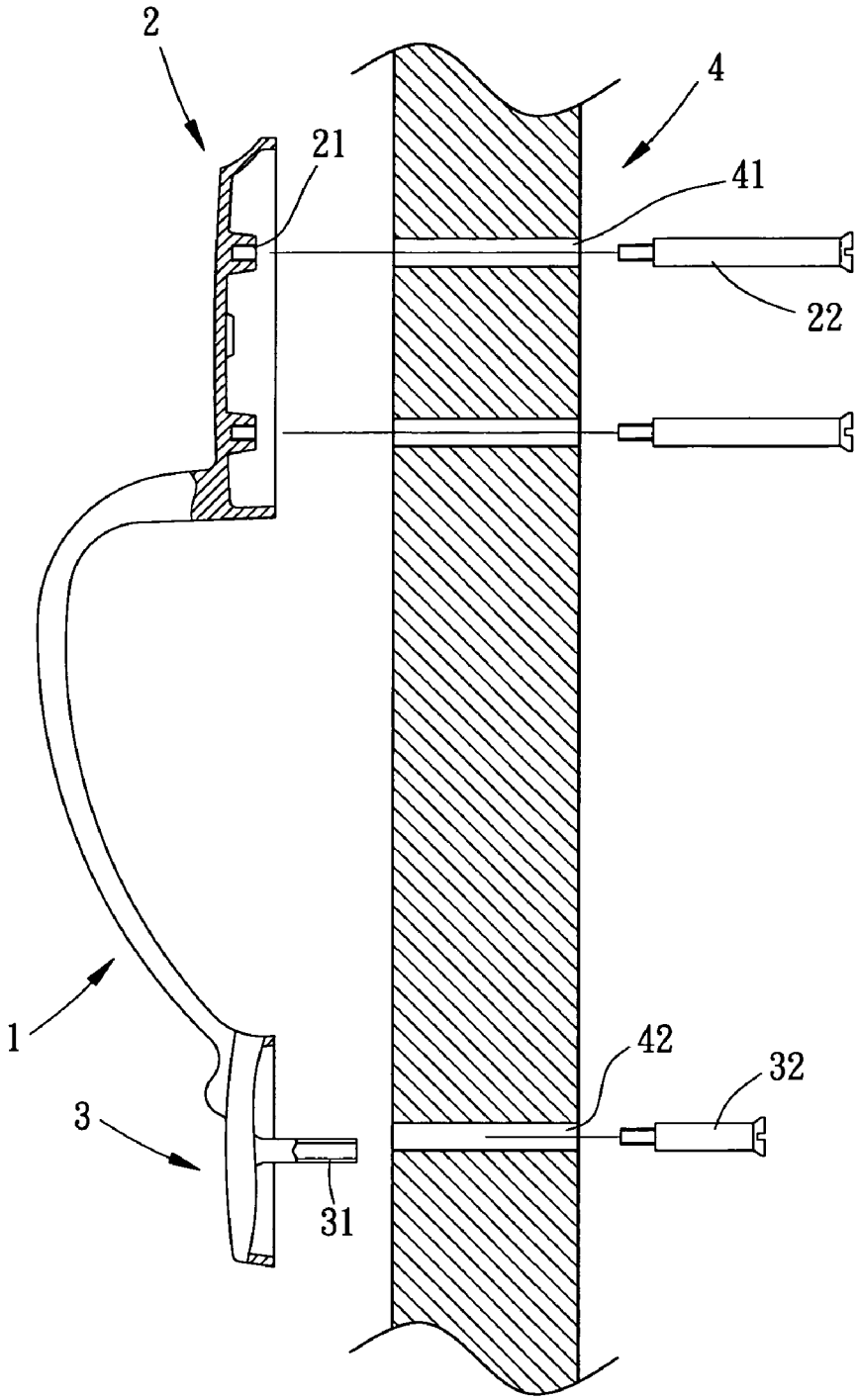
FIG. 1 PRIOR ART
FIG. 1 is an exploded sectional view of a conventional fixing structure for a door handle and a door.
Figure 2:
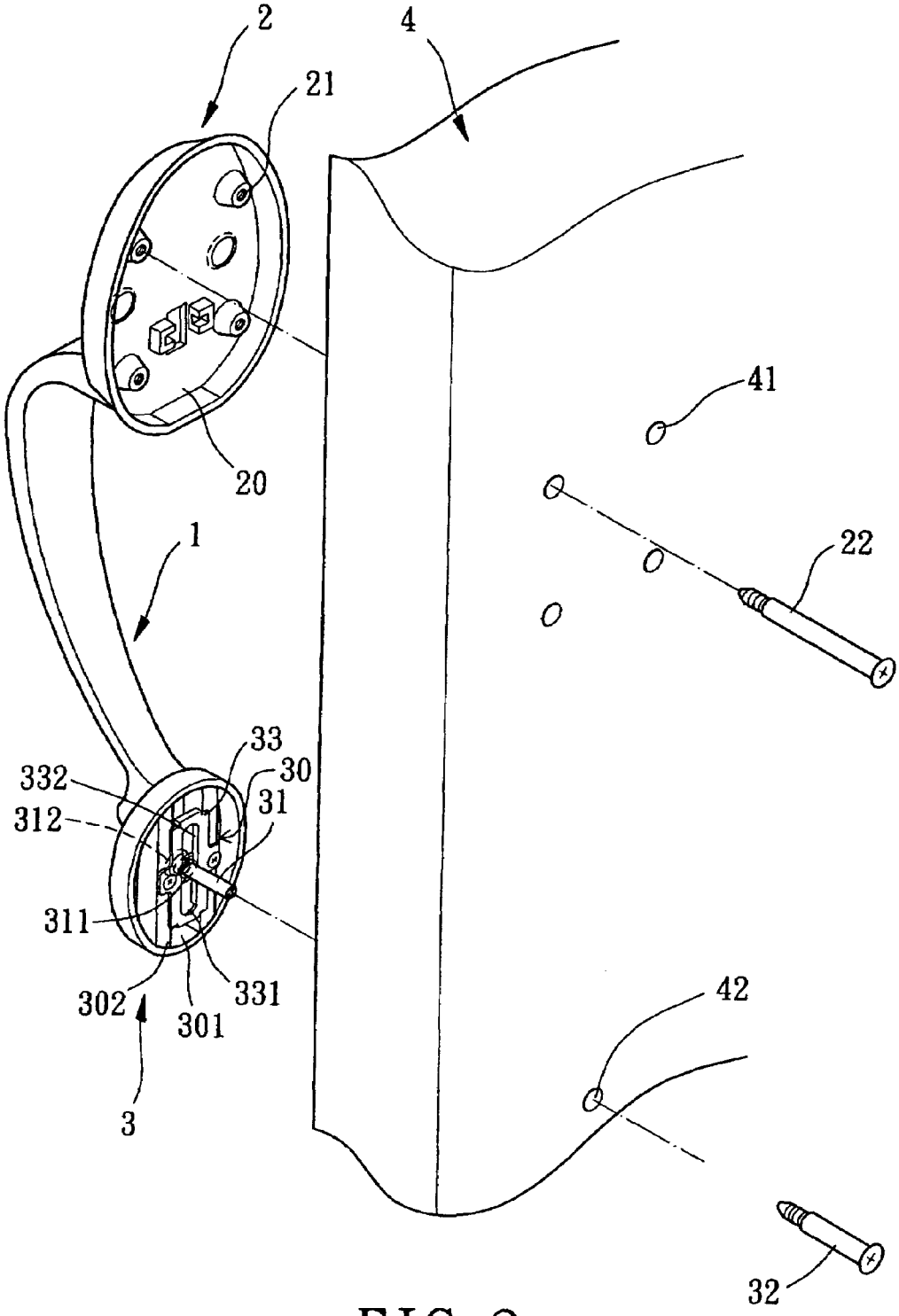
FIG. 2 is an exploded perspective view of an embodiment of a fixing structure for a door handle in accordance with the present invention and a door.

Referring to FIG. 2, an embodiment of a fixing structure for a door handle in accordance with the present invention comprises a grip portion 1, a first fixing portion 2, and a second fixing portion 3. The grip portion 1 includes two ends respectively connected to the first fixing portion 2 and the second fixing portion 3. The first fixing portion 2 and the second fixing portion 3 are used to fix the handle to a door 4. A latch mechanism (not shown) and/or a linking mechanism (not shown) can be mounted in the first fixing portion 2 to form a lock for controlling locking/unlocking of the door 4.

Still referring to FIG. 2, the first fixing portion 2 includes a first engaging face 20 with a plurality of screw holes 21. The first engaging face 20 is fixedly coupled to a side of the door 4. The second fixing portion 3 includes a second engaging face 30, at least one fixing tube 31 (only one in the illustrated embodiment) on the second engaging face 30, and a guiding plate 33 on the second engaging face 30. The second engaging face 30 is fixedly coupled to the side of the door 4. The fixing tube 31 includes an inner threading (not labeled).

Figure 3:
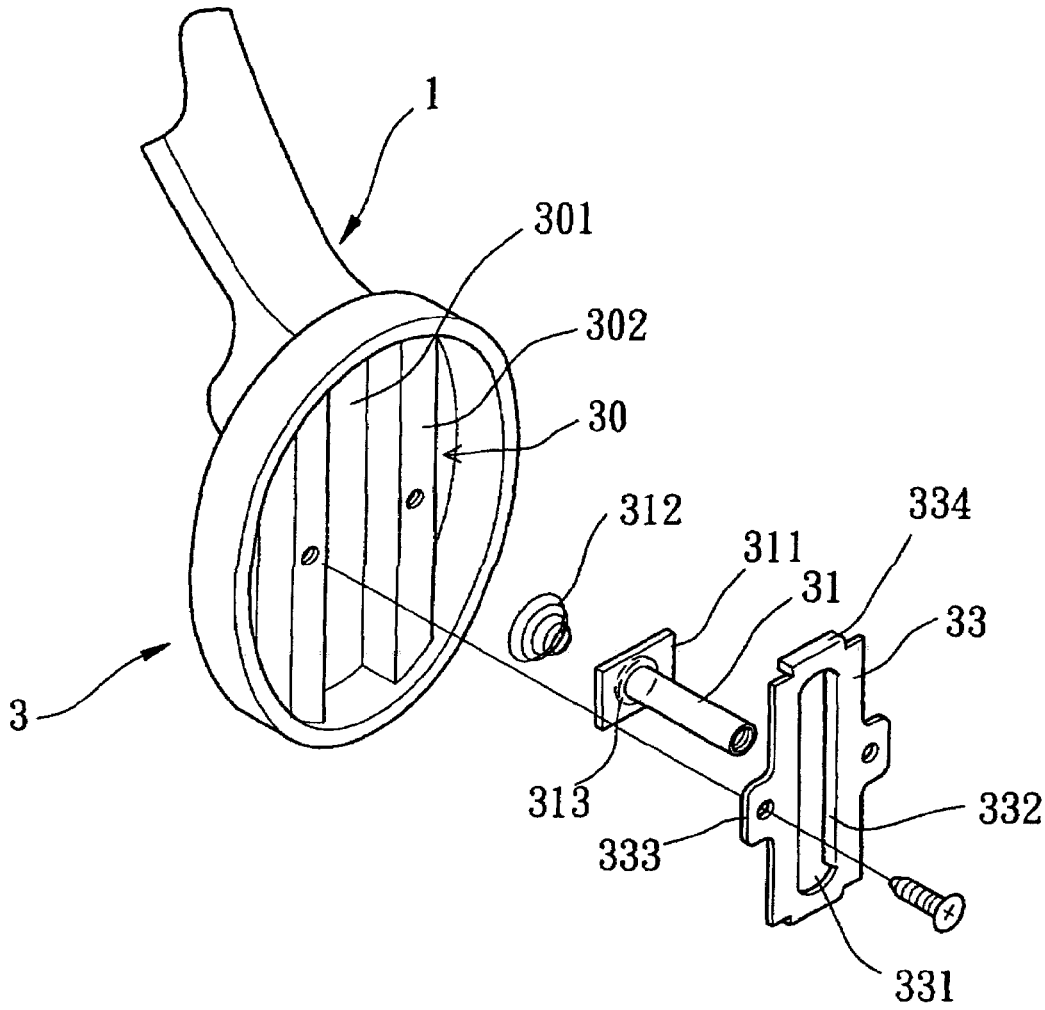
FIG. 3 is an exploded perspective view of a second fixing portion of the fixing structure in accordance with the present invention.
Figure 4:
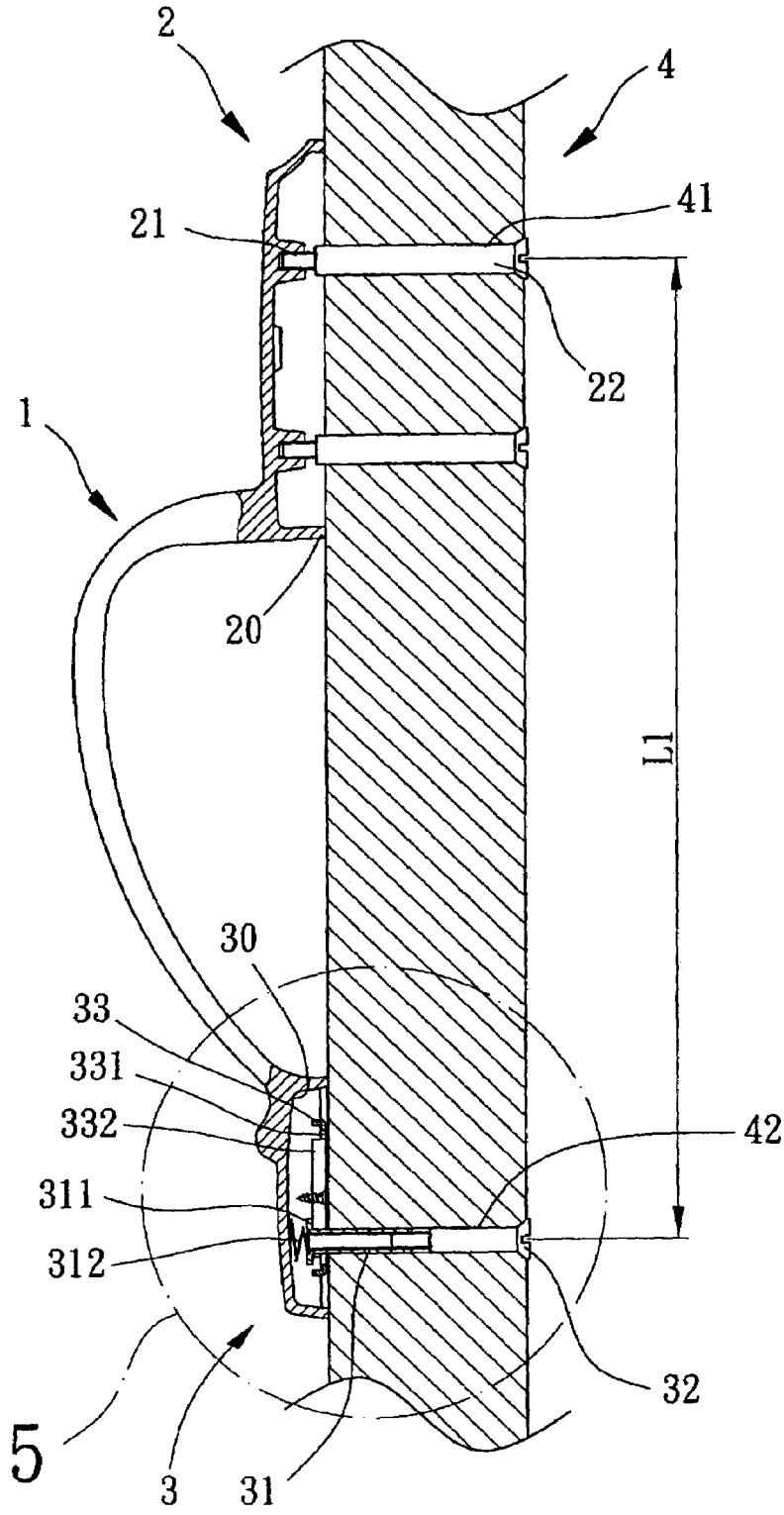
FIG. 4 is a sectional view of the fixing structure in accordance with the present invention and a door.

Referring to FIGS. 2 through 4, the door 4 includes a plurality of first mounting holes 41 associated with the screw holes 21 of the first fixing portion 2. A plurality of first screws 22 are extended from the other side of the door 4 through the first mounting holes 41 into the screw holes 21, thereby fixedly screwing the first fixing portion 2 to the side of the door 4. The door 4 further includes at least one second mounting hole 42 (only one in the illustrated embodiment) associated with the fixing tube 31. A second screw 32 is extended from the other side of the door 4 through the second mounting hole 42 into the fixing tube 31, thereby fixedly screwing the second fixing portion 3 to the side of the door 4.

Still referring to FIGS. 2 and 3, the second engaging face 30 of the second fixing portion 3 includes a pair of elongated support ribs 302 between which a groove 301 is defined. A movable plate 311 is fixed to the fixing tube 31 and slidably received in the groove 301. An elastic element 312 is mounted between a bottom wall delimiting the groove 301 and the movable plate 311 for biasing the fixing tube 31 toward the guiding plate 33. The movable plate 311 includes a recession 313 to receive an end of the elastic element 312. The movable plate 311 has a width slightly smaller than that of the groove 301.

The guiding plate 33 is an elongated metal plate fixed by screws (not labeled) to the second engaging face 30 and includes a slot 331 through which the fixing tube 31 extends. The slot 331 has a width slightly greater than an outer diameter of the fixing tube 31 and slightly smaller than the width of the movable plate 311. Thus, the movable plate 311 is biased by the elastic element 312 to press against the guiding plate 33. Preferably, the guiding plate 33 includes two abutting flanges 332 respectively formed on the two lateral edges delimiting the slot 331. A pair of lugs 333 further extend from the two outer lateral edges of the guiding plate 33, with each of the lugs 333 aligning with the corresponding support rib 302 of the second fixing portion 3. The guiding plate 33 further includes two end-bent flanges 334 at its distal edges for reinforcing the guiding plate 33, with the flanges 334 received between the support ribs 302. The movable plate 311 firmly presses against the abutting flanges 332 under the action of the elastic element 312.

Figure 5:
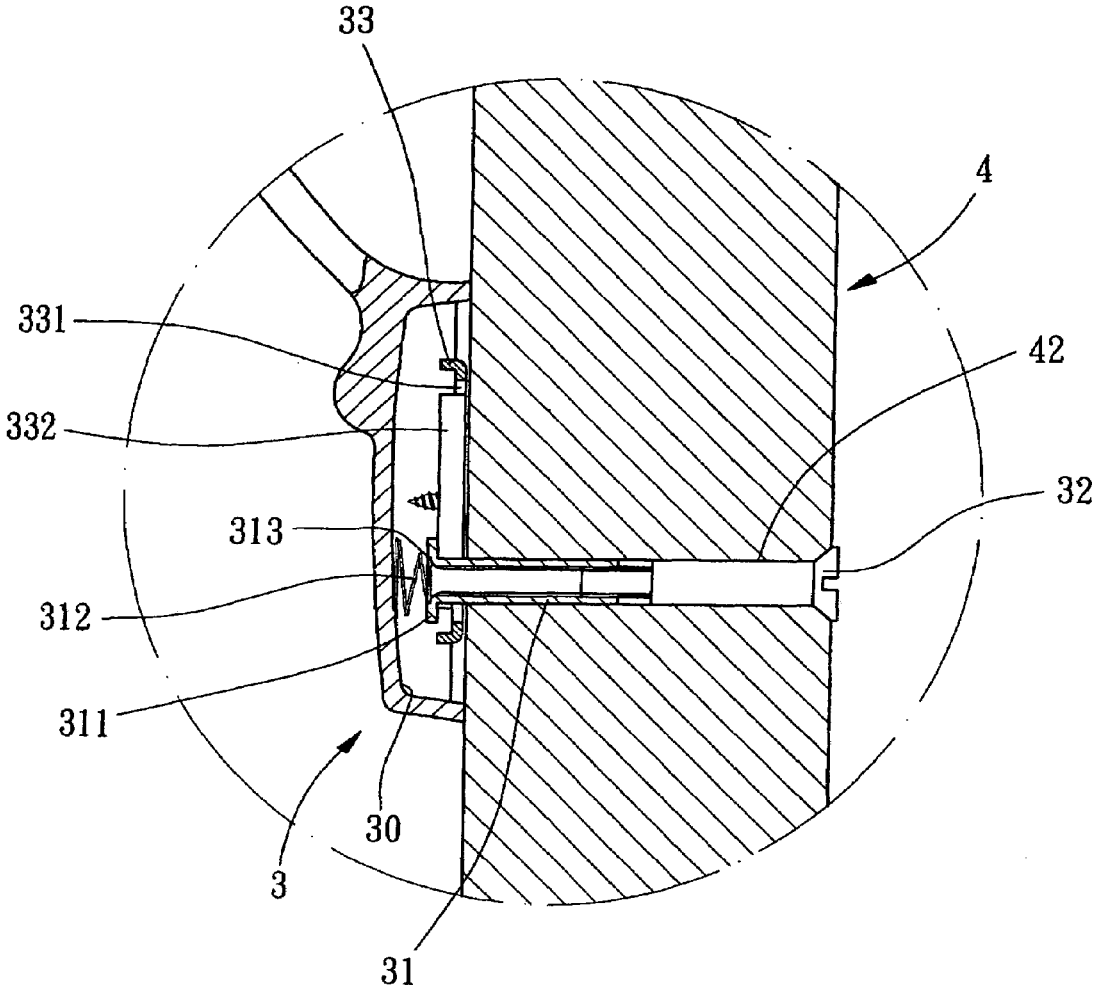
FIG. 5 is an enlarged view of a circled portion in FIG. 4.

Referring to FIGS. 4 and 5, when mounting the door handle to a door 4 of a certain specification (the distance from the second mounting hole 42 to the uppermost mounting hole 41 is L1), the first screws 22 are extended from the other side of the door 4 through the first mounting holes 41 into the screw holes 21, thereby fixedly screwing the first fixing portion 2 to the side of the door 4. Next, the fixing tube 31 is moved along the slot 331 of the guiding plate 33 until the fixing tube 31 is aligned with the second mounting hole 42 of the door 4. The second screw 32 is extended from the other side of the door 4 through the second mounting hole 42 into the fixing tube 31, thereby fixedly screwing the second fixing portion 3 to the side of the door 4. The door handle is, thus, firmly fixed to the door 4.

Figure 6:
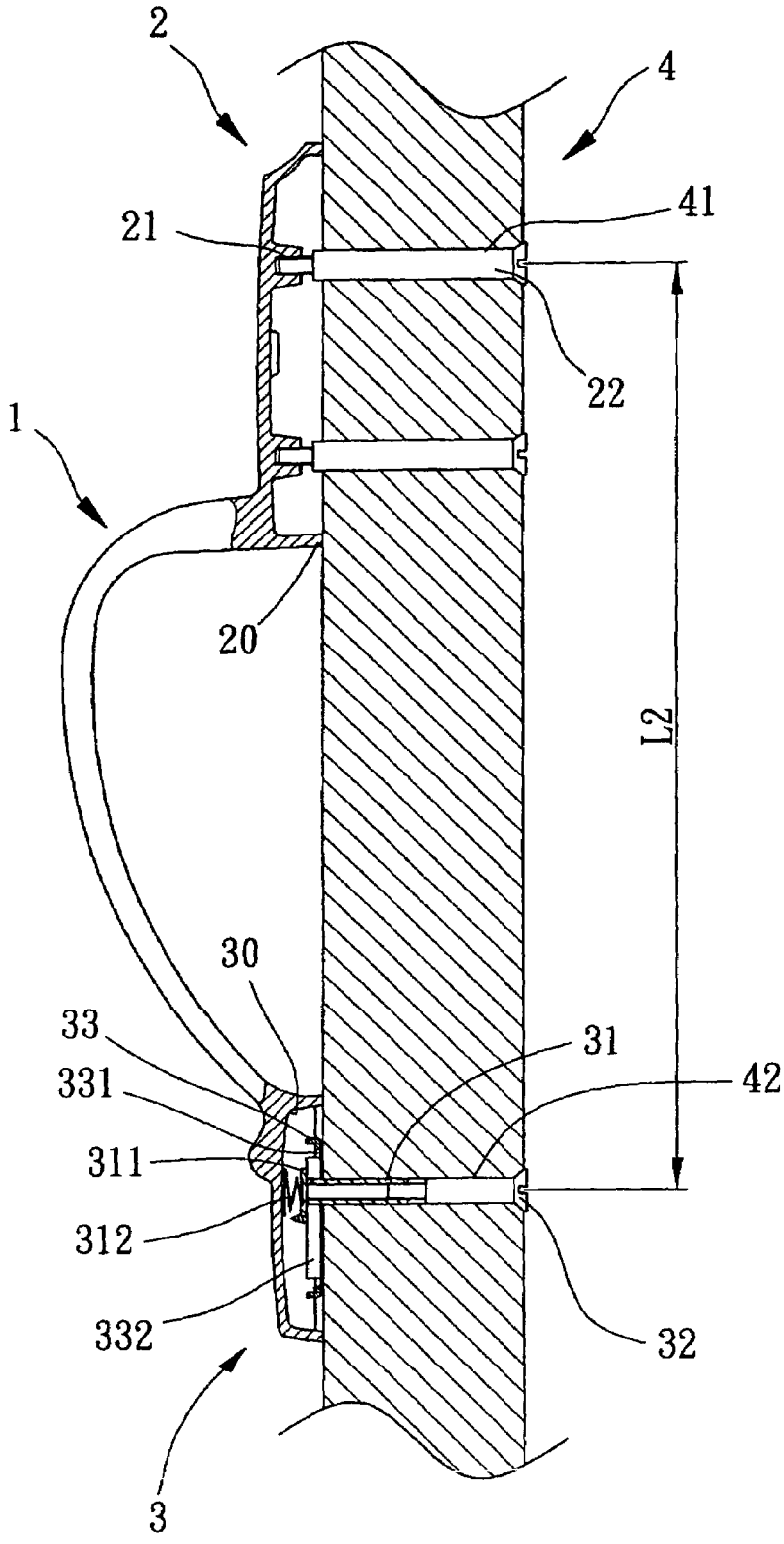
FIG. 6 is a sectional view similar to FIG. 4, illustrating flexible mounting of the door handle.

Referring to FIG. 6, when mounting the door handle to a door 4 of another specification (the distance from the second mounting hole 42 to the uppermost mounting hole 41 is L2), the first screws 22 are extended from the other side of the door 4 through the first mounting holes 41 into the screw holes 21, thereby fixedly screwing the first fixing portion 2 to the side of the door 4. Next, the fixing tube 31 is moved along the slot 331 of the guiding plate 33 until the fixing tube 31 is aligned with the second mounting hole 42 of the door 4. The second screw 32 is extended from the other side of the door 4 through the second mounting hole 42 into the fixing tube 31, thereby fixedly screwing the second fixing portion 3 to the side of the door 4. The door handle is, thus, firmly fixed to the door 4.

Thus, the door handle can be mounted to the door 4 with greater flexibility. In other words, precise drilling of the first mounting holes 41 and the second mounting hole 42 in the door 4 is no requisite, and mounting of the door handle to the door 4 is easy.

Figure 7:
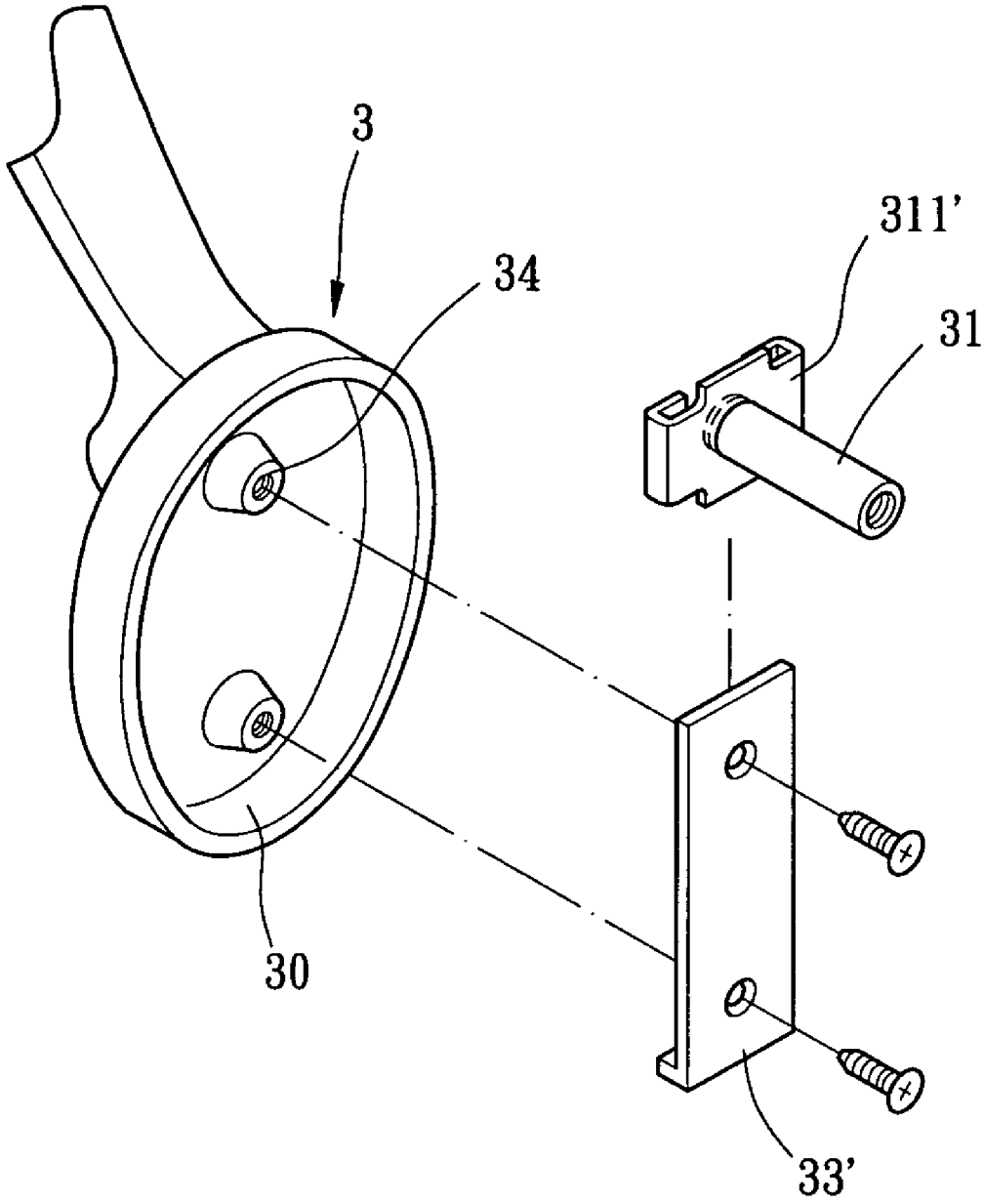
FIG. 7 is an exploded perspective view illustrating a modified embodiment of the second fixing portion of the fixing structure in accordance with the present invention.

FIG. 7 shows a modified embodiment of the second fixing portion 3 of the invention. In this embodiment, the second engaging face 30 includes two protrusions 34, and a guiding plate 33' is screwed to the protrusions 34 by fasteners (not labeled). Further, a substantially C-shaped movable plate 311' is fixed on an end of the fixing tube 31. The C-shaped movable plate 311' embraces two lateral sides of the guiding plate 33' and is slidable along the guiding plate 33'. Thus, the C-shaped movable plate 311' can be moved to a desired position in which the fixing tube 31 is aligned with the second mounting hole 42 of the door 4 for assembling purposes.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A door handle comprising:

a grip portion including a first end and a second end;

a first fixing portion connected to the first end of the grip portion, the first fixing portion being configured to combine with a side of a door;

a second fixing portion connected to the second end of the grip portion, the second fixing portion being configured to combine with the same side of the door, the second fixing portion including two support ribs;

a guiding plate having a slot, and two lugs are extended from the guiding plate, each of the two lugs is correspondingly mounted on one of the two support ribs of the second fixing portion; and a slide member including at least one fixing tube received in the slot of the guiding plate and slidably mounted in the slot of the guiding plate, thereby adjusting a position of said slide member along the slot of the guiding plate in assembling operation.

2. The door handle as claimed in claim 1, wherein said slide member further includes a plate fixed to an end thereof.

3. The door handle as claimed in claim 2, wherein the second fixing portion further includes a groove provided between the two support ribs for slidingly receiving the plate of the slide member.

4. The door handle as claimed in claim 3, wherein the guiding plate further comprises two abutting flanges on two lateral edges delimiting the slot, and wherein the plate of the slide member abuts against the abutting flanges.

5. The door handle as claimed in claim 2, further comprising an elastic element received between the two support ribs and mounted between a bottom wall delimiting a groove and a surface of the plate to bias the plate of the slide member to press against the guiding plate, thereby retaining said slide member and said at least one fixing tube in place.

6. The door handle as claimed in claim 5, wherein said slide member further includes a recession to receive an end of the elastic element.

7. The door handle as claimed in claim 5, wherein said guiding plate further includes two end-bent flanges at distal edges of the guiding plate, with the end-bent flanges received between the support ribs.

8. The door handle as claimed in claim 1, wherein said rib is an elongated rib.

9. The door handle as claimed in claim 1, wherein the support ribs are in a spaced parallel relation, with the guide plate being separately formed from, fixedly mounted to and extending between the support ribs, with the slide member including a movable plate of a size larger than the slot and with the fixing tube projecting therefrom and received in the slot, with the movable plate located between and being movable relative to the support ribs, with the movable plate located intermediate the second fixing portion and the guiding plate.

10. A door handle comprising:

a grip portion including a first end and a second end;

a first fixing portion connected to the first end of the grip portion, the first fixing portion being configured to combine with a side of a door;

a second fixing portion connected to the second end of the grip portion, the second fixing portion being configured to combine with the same side of the door, the second fixing portion including two support ribs being in a spaced parallel relation;

a guiding plate having a slot, said guiding plate being separately formed from, fixedly mounted to and extending between said support ribs of the second fixing portion;

a slide member including at least one fixing tube received in the slot of the guiding plate and slidably mounted in the slot of the guiding plate, thereby adjusting a position of said slide member along the slot of the guiding plate in an assembling operation, with the slide member including a movable plate of a size larger than the slot and with the fixing tube projecting therefrom and received in the slot, with the movable plate located between and being movable relative to the support ribs, with the movable plate located intermediate the second fixing portion and the guiding plate; and two abutting flanges being provided on two lateral edges delimiting the slot of the guiding plate, with the two abutting flanges integrally extending from the guiding plate towards the second fixing portion, with the two abutting flanges being intermediate the support ribs, and wherein the movable plate of the slidable member abuts against the abutting flanges in a spaced, parallel relation to the guiding plate.

11. The door handle as claimed in claim 10, further comprising two end-bent flanges integrally extending at distal edges of the guiding plate and towards the second fixing portion, with the two end-bent flanges located between the support ribs, with the two end-bent flanges extending perpendicular to the guiding plate and the two abutting flanges.

12. The door handle as claimed in claim 11, further comprising two lugs integrally extending from the guiding plate and mounted on the support ribs, with the two abutting flanges extending perpendicular to the two lugs.

13. The door handle as claimed in claim 12, further comprising an elastic element, with the support ribs defining a groove therebetween having a bottom wall, with the elastic element received between the support ribs and mounted between the bottom wall of the groove and the movable plate to bias the movable plate of the slide member to press against the guiding plate, thereby retaining said slide member and said at least one fixing tube in place.

14. The door handle as claimed in claim 13, wherein said movable plate of the slide member further includes a recession to receive an end of the elastic element.

15. A door handle comprising:

a strip portion including a first end and a second end;

a first fixing portion connected to the first end of the trip portion, the first fixing portion being configured to combine with a side of a door;

a second fixing portion connected to the second end of the grip portion, the second fixing portion being configured to combine with the same side of the door, the second fixing portion including two support ribs being in a spaced parallel relation and defining a groove therebetween having a bottom wall;

a guiding plate having a slot, said guiding plate being separately formed from, fixedly mounted to and extending between said support ribs of the second fixing portion;

a slide member including at least one fixing tube received in the slot of the guiding plate and slidably mounted in the slot of the guiding plate, thereby adjusting a position of said slide member along the slot of the guiding plate in an assembling operation, with the slide member including a movable plate of a size larger than the slot and with the fixing tube projecting therefrom and received in the slot, with the movable plate located between and being movable relative to the support ribs, with the movable plate located intermediate the second fixing portion and the guiding plate; and an elastic element received between the support ribs and mounted between the bottom wall of the groove and the movable plate to bias the movable plate of the slide member to press against the guiding plate, thereby retaining said slide member and said at least one fixing tube in place.

16. The door handle as claimed in claim 15, wherein said movable plate of the slide member further includes a recession to receive an end of the elastic element.

* * * * *